US008444311B2

(12) United States Patent
Chen

(10) Patent No.: US 8,444,311 B2
(45) Date of Patent: May 21, 2013

(54) LAMP HOLDER STRUCTURE WITH UNIVERSAL ACCOMMODATING SLOT

(75) Inventor: Tsan-Chi Chen, Chung-Ho (TW)

(73) Assignee: Tsan-Chi Chen, Chung Ho, Taipei Hsien (TW)

( * ) Notice: Subject to any disclaimer, the term of this patent is extended or adjusted under 35 U.S.C. 154(b) by 217 days.

(21) Appl. No.: 13/090,454

(22) Filed: Apr. 20, 2011

(65) Prior Publication Data

US 2012/0268955 A1 Oct. 25, 2012

(51) Int. Cl.
*H01R 33/00* (2006.01)

(52) U.S. Cl.
USPC ..... 362/650; 362/394

(58) Field of Classification Search
USPC ..... 362/394, 640, 649–652, 655–659; 313/49–51; 439/296–381, 527–576, 775–891
See application file for complete search history.

(56) References Cited

U.S. PATENT DOCUMENTS 5,154,628 A * 10/1992 Skegin ..... 439/336

* cited by examiner

*Primary Examiner* — Jason Moon Han
(74) *Attorney, Agent, or Firm* — Bacon & Thomas, PLLC

(57) ABSTRACT

The present invention relates to a lamp holder structure comprising a main body having a universal accommodating slot and an accommodating space concavely formed at the top and the bottom of the main body respectively, and a first electrically conductive plate and a second electrically conductive plate both installed at the top of the main body proximate to the universal accommodating slot, wherein the second electrically conductive plate is electrically coupled with a lamp holder base contained in the accommodating space, a metal spring plate is embedded into the main body, and a pressing element is contained in the universal accommodating slot and can be rotated or moved back and forth in the universal accommodating slot for pressing against a flange of the metal spring plate, such that the metal spring plate can be electrically coupled to or detached from the first electrically conductive plate.

20 Claims, 9 Drawing Sheets

LAMP HOLDER STRUCTURE WITH UNIVERSAL ACCOMMODATING SLOT

FIELD OF THE INVENTION

The present invention relates to a lamp holder structure comprising a main body having a universal accommodating slot and an accommodating space concavely formed at the top and the bottom of the main body respectively, and a first electrically conductive plate and a second electrically conductive plate both installed at the top of the main body proximate to the universal accommodating slot, wherein the second electrically conductive plate is electrically coupled with a lamp holder base contained in the accommodating space, a metal spring plate is embedded into the main body, and a pressing element is contained in the universal accommodating slot and can be rotated or moved back and forth in the universal accommodating slot for pressing against a flange of the metal spring plate, such that the metal spring plate can be electrically coupled to or detached from the first electrically conductive plate. Since the design of the lamp holder structure of the present invention simply uses the metal spring plate and the pressing element for switching the power supply, therefore the invention can achieve the effects of reducing the quantity of components and simplifying the assembling procedure significantly.

BACKGROUND OF THE INVENTION

With reference to FIG. 1 for a conventional lamp holder structure, the conventional lamp holder structure 10 comprises a rotating axial device 11, an external sleeve 12 and a cover 13, wherein a first power cord 111 and a second power cord 112 are connected to the top of the rotating axial device 11, and an electrically conductive plate 113 and a lamp holder base 114 are connected to the bottom of the rotating axial device 11, and the lamp holder base 114 is attached onto the bottom of the rotating axial device 11 and electrically coupled to the first power cord 111. The lamp holder base 114 includes an opening 115 formed thereon and provided for extending the electrically conductive plate 113 through the opening 115 into the lamp holder base 114. After the rotating axial device 11 and the lamp holder base 114 are integrally assembled, the rotating axial device 11 and the lamp holder base 114 can be accommodated in an accommodating space 121 of the external sleeve 12, such that a knob 116 installed on the rotating axial device 11 is extended outside the external sleeve to cover the cover 13 onto the top of the external sleeve 12 and shelter the rotating axial device 11. The rotating axial device 11 and the lamp holder base 114 are positioned in the accommodating space 121 of the external sleeve 12, and the first power cord 111 and the second power cord 112 are passed through the through hole 131 of the cover 13 and electrically connected to an external power supply. Therefore, after the conventional lamp holder structure 10 is integrally assembled, users can install a lamp cap (not shown in the figure) of an illumination lamp to the lamp holder base 114, such that the lamp cap of the illumination lamp is electrically connected to the lamp holder base 114 and the electrically conductive plate 113. The knob 116 of the rotating axial device 11 can be turned in order to electrically connect the electrically conductive plate 113 and the second power cord 112, such that the power of the illumination lamp can be turned on to emit light.

The aforementioned conventional lamp holder structure 10 is convenient and popular, and thus new products of this sort are introduced to the market constantly. The conventional lamp holder structure 20 as shown in FIG. 2 comprises a push lever device 21, an external sleeve 22 and a cover 23, wherein a first power cord 211 and a second power cord 212 are coupled to the top of the push lever device 21, and an electrically conductive plate 213 and a lamp holder base 214 are coupled to the bottom of the push lever device 21, and the lamp holder base 214 is attached to the bottom of the push lever device 21 and electrically coupled to the first power cord 211. The lamp holder base 214 includes an opening 215 formed thereon and provided for extending the electrically conductive plate 213 through the opening 215 into the lamp holder base 214, such that after the push lever device 21, the external sleeve 22 and the cover 23 are integrally assembled, and a lamp cap (not shown in the figure) of an illumination lamp is installed to the lamp holder base 214, a user simply needs to push a push lever 216 installed on the push lever device 21 to electrically conduct the electrically conductive plate 213 and the second power cord 212, so as to turn on the illumination lamp to emit light. In addition, the conventional lamp holder structure 30 as shown in FIG. 3 comprises a stringer bead wheel device 31, an external sleeve 32 and a cover 33, wherein a first power cord 311 and a second power cord 312 are installed at the top of the stringer bead wheel device 31, and an electrically conductive plate 313 and a lamp holder base 314 are disposed at the bottom of the stringer bead wheel device 31, and the lamp holder base 314 is attached onto the bottom of the stringer bead wheel device 31 and electrically coupled to the first power cord 311. The lamp holder base 314 includes an opening 315 formed thereon and provided for extending the electrically conductive plate 313 through the opening 315 into the lamp holder base 314, such that after the stringer bead wheel device 31, the external sleeve 32 and the cover 33 are integrally assembled, and a lamp cap (not shown in the figure) of an illumination lamp is installed to the lamp holder base 314, the user simply requires pulling a stringer bead 316 installed on the stringer bead wheel device 31 to electrically conduct the electrically conductive plate 313 and the second power cord 312, so as to turn on the power of the illumination lamp to emit light.

Although the use of the aforementioned conventional lamp holder structures 10, 20, 30 are convenient, their actual manufacture still has problems. For example, the conventional lamp holder structures 10, 20, 30 include the rotating axial device 11, the push lever device 21 and the stringer bead wheel device 31, but their size, structure and circuit layout come with different specifications, and thus the conventional lamp holder structures 10, 20, 30 have different specifications, and manufacturers need to set up different production lines and purchase different molds and components for the production of the conventional lamp holder structures 10, 20, 30 of different specifications in order to meet the market requirements, due to the various different specifications of the rotating axial device 11, the push lever device 21 and the stringer bead wheel device 31. As a result, the manufacturers have to purchase more components and waste unnecessary expenses and assembling time. Obviously, the assembling procedure of the lamp holder structure becomes more complicated. As the market demand for the lamp holder structure of a certain specification rises drastically and the market demand for the lamp holder structure of other specifications drops drastically, the manufacturers have to increase the number of product lines for the lamp holder structure of one specification and decrease the number of production lines for the lamp holder structure of the other specification, and thus making the production management more complicated, and causing a delay of production schedule easily. Furthermore, the manufacturers have to make the molds in advance or purchase the expensive and complicated rotating axial device 11, push lever device 21 or stringer bead wheel device 31, and then install these components to the conventional lamp holder structure 10, 20, 30, so that the production cost for the manufacture and assembling of the components of the conventional lamp holder structure 10, 20, 30 must be increased, and the increase of the cost is definitely an unfavorable factor to the manufacturers.

To overcome the foregoing drawbacks of the conventional lamp holder structure 10, 20, 30 such as a complicated assembling procedure and a high production cost for the manufacture and assembling of the components, it is a key point of the present invention to design a novel lamp holder structure to allow manufacturer to install various different types of pressing elements into a universal accommodating slot of the same lamp holder structure, so as to achieve the effects of mass producing the lamp holder structures of different specifications, reducing the quantity of components, and simplifying the assembling procedure.

SUMMARY OF THE INVENTION

In view of the aforementioned shortcomings of the conventional lamp holder structure with a complicated assembling procedure, the inventor of the present invention based on years of experience in the related industry to conduct extensive researches and experiments, and finally developed a lamp holder structure with a universal accommodating slot, in hope of providing a convenient and quick way of manufacturing a large quantity of lamp holder structures of various different specifications.

Therefore, it is a primary objective of the present invention to provide a lamp holder structure with a universal accommodating slot, and the lamp holder structure comprises a main body, a first electrically conductive plate, a metal spring plate, a second electrically conductive plate, a lamp holder base and a pressing element (such as an axle, a push lever, or a stringer bead wheel), wherein an accommodating space is concavely formed at the bottom of the main body, and a universal accommodating slot is concavely formed at the top of the main body. The first electrically conductive plate is installed at the top of the main body and at a position proximate to the universal accommodating slot. An end of the first electrically conductive plate is extended to the bottom of the universal accommodating slot, and the other end of the first electrically conductive plate is electrically coupled to a first electric wire. The metal spring plate is embedded into the main body, and an end of the metal spring plate is extended and fixed into the accommodating space, and the other end of the metal spring plate is extended and fixed into the universal accommodating slot, wherein a predetermined interval is maintained between the metal spring plate and an end of the first electrically conductive plate. The metal spring plate includes a flange formed at a position proximate to the other end of the metal spring plate, such that when an external force is applied to the flange, the other end of the metal spring plate is driven to press against an end of the first electrically conductive plate, so that the metal spring plate and the first electrically conductive plate are electrically coupled to one another. If the flange is not pressed by any external force, the other end of the metal spring plate will be detached from the first electrically conductive plate due to the stress of the metal spring plate, so that the metal spring plate and the first electrically conductive plate are electrically isolated. The second electrically conductive plate is installed at the top of the main body and at a position proximate to the universal accommodating slot, and an end of the second electrically conductive plate is extended to the accommodating space at the bottom of the main body, and the other end of the second electrically conductive plate is provided for electrically coupling a second electric wire. The lamp holder base is contained in the accommodating space, and the top of the lamp holder base is pressed against an end of the second electrically conductive plate, such that the lamp holder base and the second electrically conductive plate are electrically coupled with each other. The lamp holder base includes an opening formed thereon for extending an end of the metal spring plate through the opening into the lamp holder base. The lamp holder base further includes an assembling slot concavely formed thereon and provided for assembling a lamp cap of an illumination lamp, such that an end of the lamp cap is pressed against an end of the metal spring plate, and the periphery of the lamp cap is electrically coupled to the second electrically conductive plate through the lamp holder base. The pressing element is contained in the universal accommodating slot and can be rotated or moved back and forth in the universal accommodating slot. The pressing element includes at least one pressing portion formed thereon and can be rotated or moved with the pressing element to press against a flange of the metal spring plate, such that the metal spring plate can be electrically coupled to the first electrically conductive plate, or detached from the flange of the metal spring plate, and the metal spring plate and the first electrically conductive plate are electrically disconnected from each other.

Another objective of the present invention is to provide a method for manufacturers to install a pressing element of various different types such as an axle, a push lever or a stringer bead wheel into the universal accommodating slot of the same lamp holder structure to mass produce different models of the lamp holder structures conveniently and quickly, without requiring an increase of production lines. Since the design of the lamp holder structure of the present invention simply uses a metal spring plate and a pressing element for switching the power supply, therefore the invention can achieve the effects of reducing the quantity of components and simplifying the assembling procedure significantly. In addition, the invention can lower the component manufacturing and assembling costs incurred in the assembling procedure of the conventional lamp holder structure that requires manufacturers to manufacture or purchase expensive rotating axial devices, push lever devices or stringer bead wheel devices.

BRIEF DESCRIPTION OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE PREFERRED EMBODIMENTS

Figure 1:
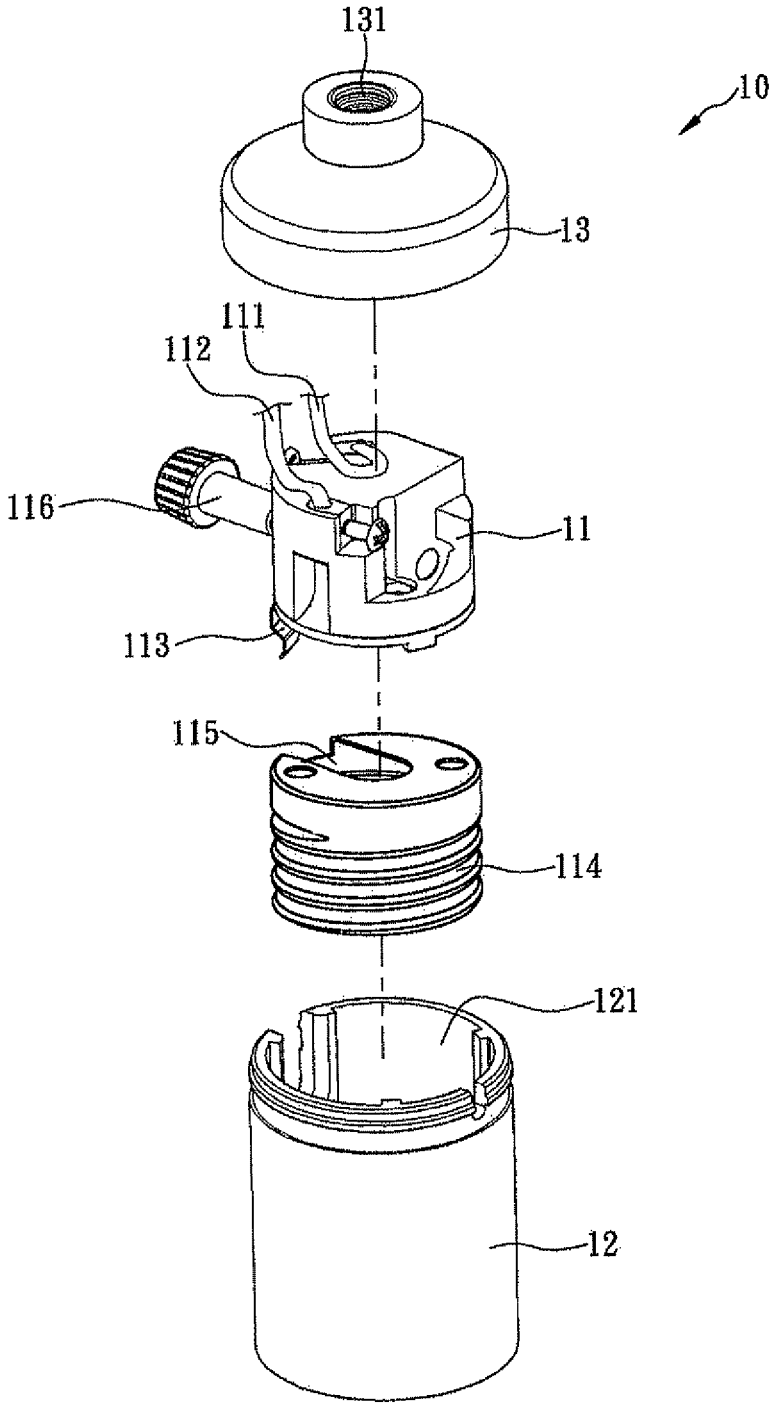
FIG. 1 (Prior Art)
FIG. 1 is a schematic view of a conventional lamp holder structure.
Figure 2:
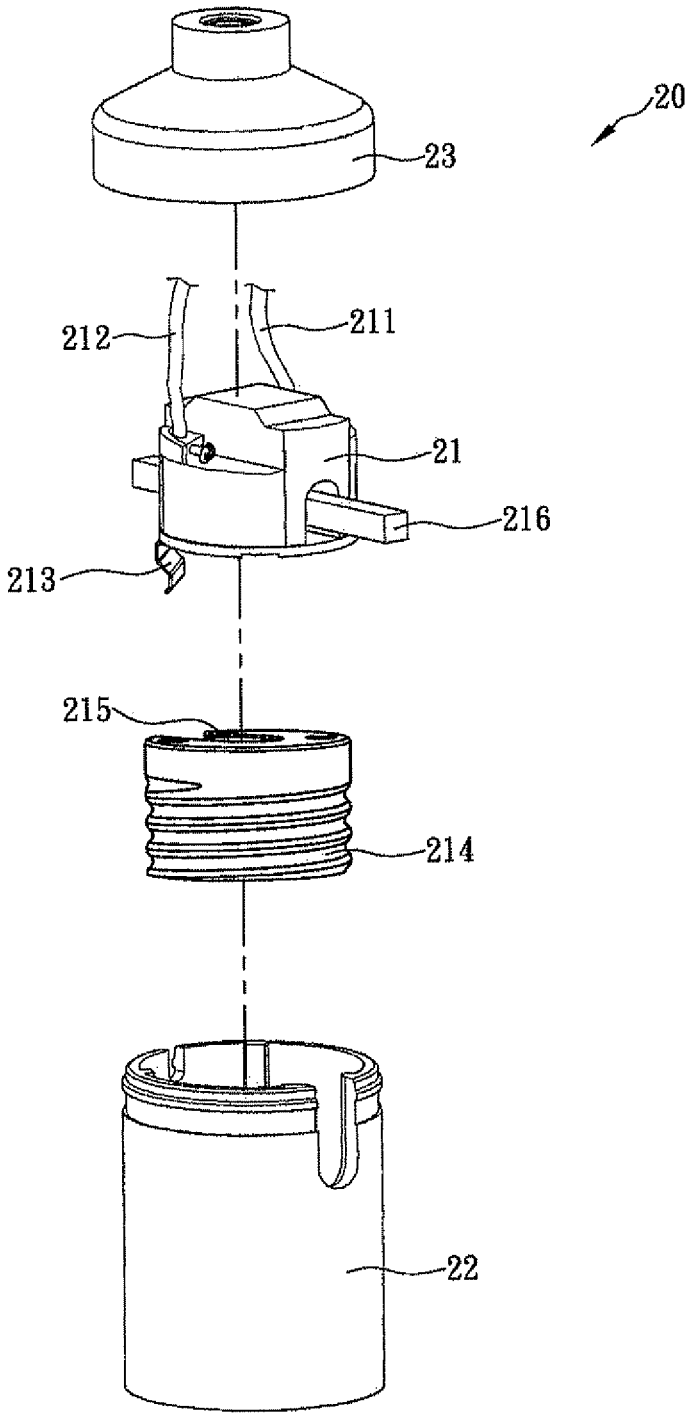
FIG. 2 (Prior Art)
FIG. 2 is another schematic view of a conventional lamp holder structure.
Figure 3:
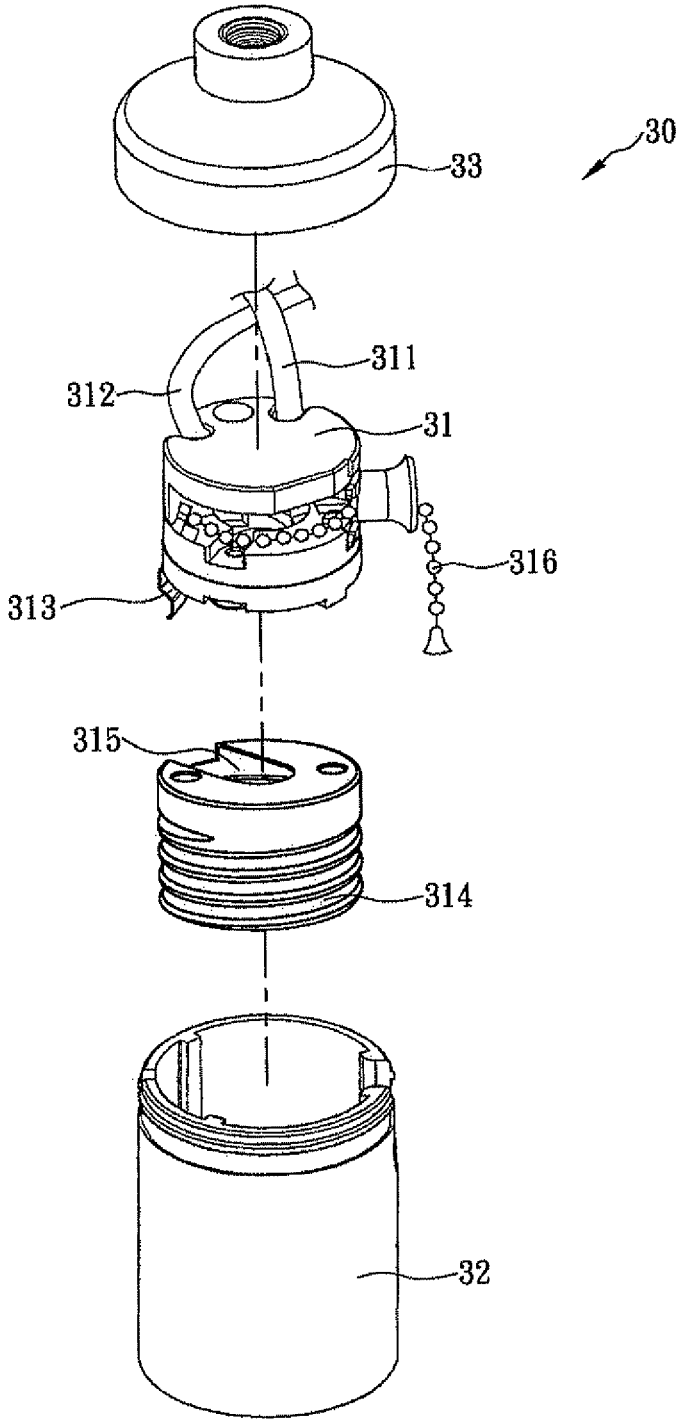
FIG. 3 (Prior Art)
FIG. 3 is a further schematic view of a conventional lamp holder structure.
Figure 4:
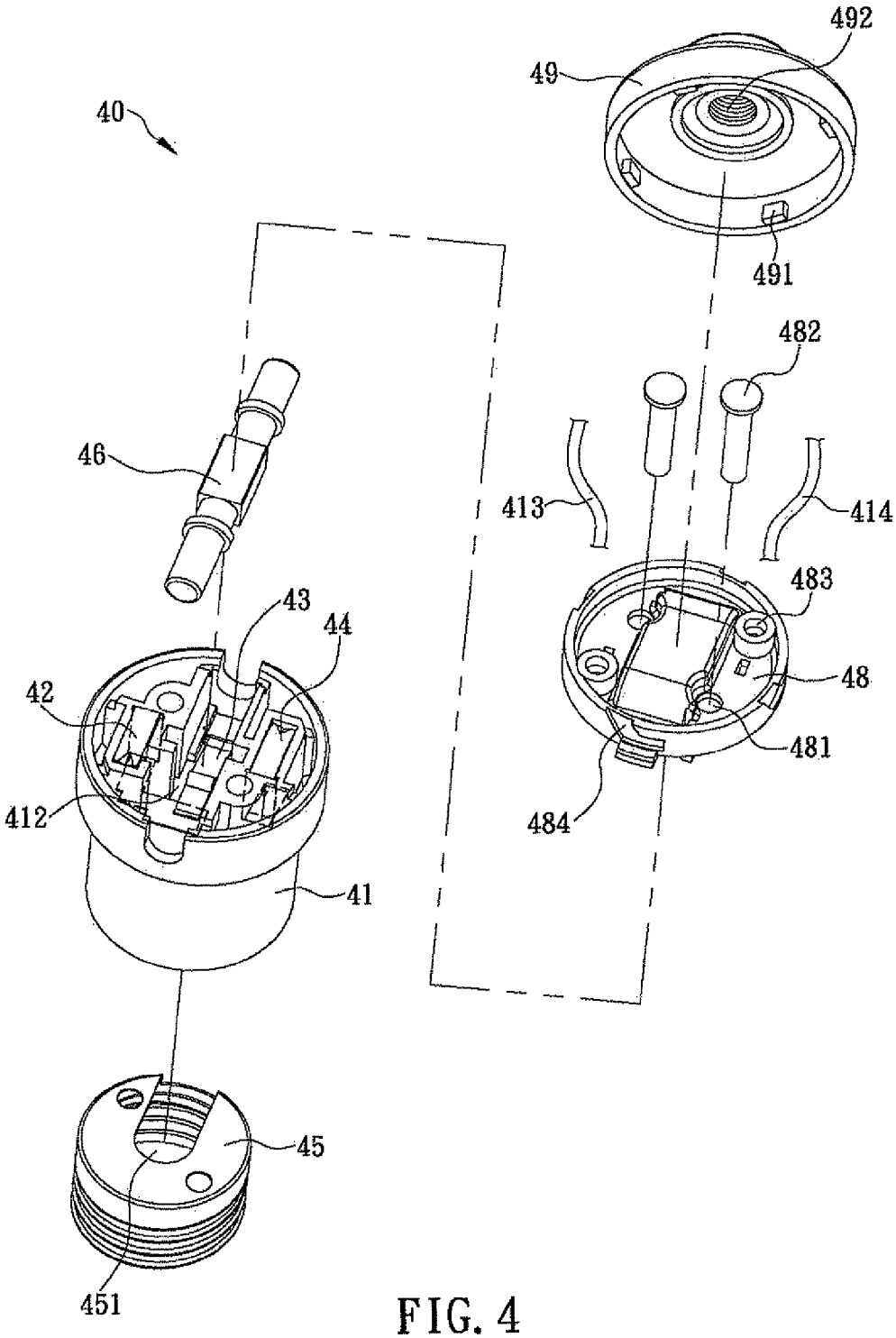
FIG. 4 is a schematic view of a first preferred embodiment of the invention.
Figure 5:
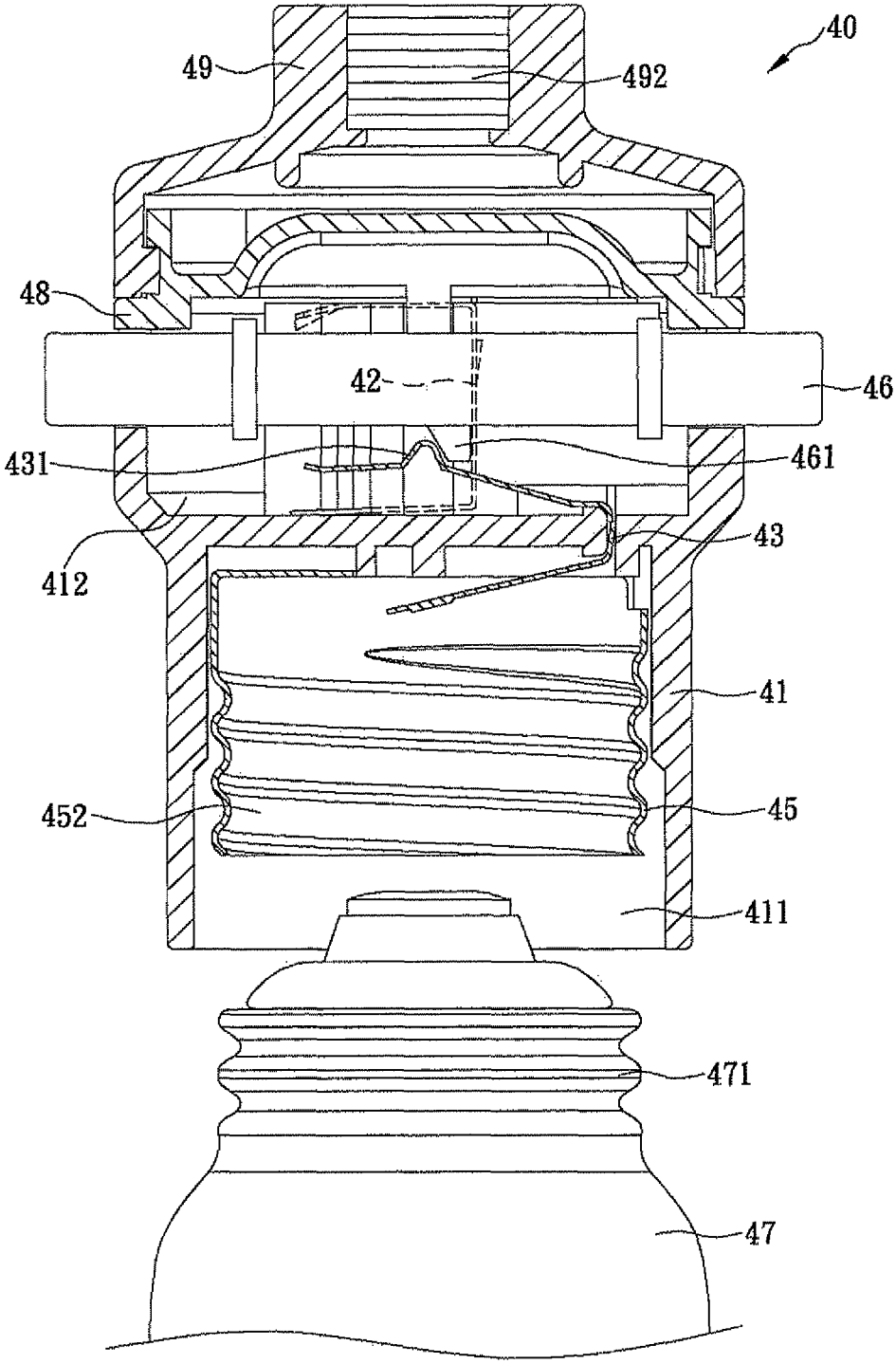
FIG. 5 is another schematic view of a first preferred embodiment of the invention.

With reference to FIGS. 4 and 5 for a lamp holder structure with a universal accommodating slot in accordance with a first preferred embodiment of the present invention, the lamp holder structure 40 comprises a main body 41, a first electrically conductive plate 42, a metal spring plate 43, a second electrically conductive plate 44, a lamp holder base 45 and a pressing element 46, wherein an accommodating space 411 is concavely formed at the bottom of the main body 41, and a universal accommodating slot 412 is concavely formed at the top of the main body 41. The first electrically conductive plate 42 is installed at the top of the main body 41 and a position proximate to the universal accommodating slot 412, and an end of the first electrically conductive plate 42 is extended to the bottom of the universal accommodating slot 412, and the other end the universal accommodating slot 412 is electrically coupled to a first electric wire 413. The metal spring plate 43 is embedded into the main body 41, and an end of the metal spring plate 43 is extended and fixed into the accommodating space 411, and the other end of the metal spring plate 43 is extended and fixed into the universal accommodating slot 412, wherein a predetermined interval is maintained between the metal spring plate 43 and an end of the first electrically conductive plate 42.

With reference to FIGS. 4 and 5, the metal spring plate 43 includes a flange 431 formed at a position proximate to another end of the metal spring plate 43, such that if an external force is applied to the flange 431, the other end of the metal spring plate 43 will be abutted against an end of the first electrically conductive plate 42, and the metal spring plate 43 and the first electrically conductive plate 42 will be electrically coupled with each other. If the flange 431 is not pressed by an external force, the other end of the metal spring plate 43 will be detached from the first electrically conductive plate 42 by the stress of the metal spring plate 43, so that the metal spring plate 43 and the first electrically conductive plate 42 are electrically disconnected from each other, and the second electrically conductive plate 44 is installed at the top of the main body 41 and a position proximate to the universal accommodating slot 412, and an end of the second electrically conductive plate 44 is extended into the accommodating space 411 at the bottom of the main body 41, and the other end of the second electrically conductive plate 44 is provided for electrically coupling a second electric wire 414, and the lamp holder base 45 is accommodated in the accommodating space 411, whose top is pressed against an end of the second electrically conductive plate 44, such that the lamp holder base 45 and the second electrically conductive plate 44 are electrically coupled with each other, and the lamp holder base 45 includes an opening 451 formed thereon and provided for passing an end of the metal spring plate 43 through the opening 451 into the lamp holder base 45, and the lamp holder base 45 includes an assembling slot 452 concavely formed thereon and provided for assembling a lamp cap 471 of an illumination lamp 47, such that an end of the lamp cap 471 is abutted against an end of the metal spring plate 43, and the periphery of the lamp cap 471 is electrically coupled to the second electrically conductive plate 44 through the lamp holder base 45.

The pressing element 46 is installed and contained in the universal accommodating slot 412, wherein the pressing element 46 of this preferred embodiment is a push lever that can be moved back and forth in the universal accommodating slot 412, and the pressing element 46 includes at least one pressing portion 461 formed thereon and movable together with the pressing element 46 to press against a flange 431 of the metal spring plate 43, such that the metal spring plate 43 can be electrically coupled to the first electrically conductive plate 42, or detached from the flange 431 of the metal spring plate 43, and the metal spring plate 43 and the first electrically conductive plate 42 are electrically disconnected from each other.

In this preferred embodiment as shown in FIG. 4, the first electrically conductive plate 42 is an anode, and an end of the first electrically conductive plate 42 can be connected to or detached from the metal spring plate 43, and the other end of the first electrically conductive plate 42 can be electrically coupled to the first electric wire 413. The second electrically conductive plate 44 is a cathode, and an end of the second electrically conductive plate 44 is electrically coupled to the lamp holder base 45, and the other end of the second electrically conductive plate 44 is electrically coupled to the second electric wire 414. However, in practical applications, the first electrically conductive plate 42 can be a cathode and the second electrically conductive plate 44 can be an anode, and their installation positions can be switched by manufacturers according to the actual requirements, and the present invention is not limited to the arrangement as shown in FIG. 4 only.

In this preferred embodiment, the lamp holder structure 40 further comprises an internal cover 48, and two positioning holes 481 formed on the internal cover 48, and each positioning hole 481 being provided for passing a positioning element 482, wherein the positioning element 482 is a screw or a rivet, such that the internal cover 48 can be secured or riveted to the top of the main body 41 through the two positioning elements 482 to cover the universal accommodating slot 412, the first electrically conductive plate 42, the second electrically conductive plate 44 and the pressing element 46. The first electrically conductive plate 42, the second electrically conductive plate 44 and the pressing element 46 are fixed into the main body 41.

In addition, the internal cover 48 further includes two electric wire through holes 483, and each electric wire through hole 483 is provided for passing the first electric wire 413 or the second electric wire 414, such that when an end of the first electric wire 413 passing through the corresponding electric wire through hole 483 and the other end of the first electrically conductive plate 42 are electrically coupled with one another, and an end of the second electric wire 414 passing through the corresponding electric wire through hole 483 and the other end of the second electrically conductive plate 44 are electrically coupled with one another, the internal cover 48 can be secured to the top of the main body 41. An end of the first electric wire 413 and the second electric wire 414 is pressed and fixed to the top of the main body 41.

In this preferred embodiment, the lamp holder structure 40 further comprises an external cover 49, a plurality of bumps 491 convexly formed at an internal periphery of the external cover 49, and a plurality of embedding grooves 484 concavely formed at an external periphery of the internal cover 48, wherein the bumps 491 are corresponsive to the embedding grooves 484 respectively, and each bump 491 can be embedded into its corresponding embedding groove 484, such that the external cover 49 can be integrally engaged with the internal cover 48 through the bumps 491. In addition, an external cover hole 492 is formed on the external cover 49 for passing the first electric wire 413 and the second electric wire 414 through the external cover hole 492 and electrically coupled to an external power supply.

As a result, manufacturers simply require installing the pressing element 46 into the universal accommodating slot 412 of the lamp holder structure 40 in order to mass produce the lamp holder structures 40 conveniently and quickly. Since the design of the lamp holder structure 40 of the present invention adopts the metal spring plate 43 and the pressing element 46 for switching the power supply, therefore the quantity of components can be reduced significantly, and the assembling procedure can be simplified effectively. In addition, the invention also can reduce the component manufacturing and assembling costs, since manufacturers of the conventional lamp holder structure have to manufacture or purchase expensive rotating axial device, push lever device or stringer bead wheel device.

Figure 6:
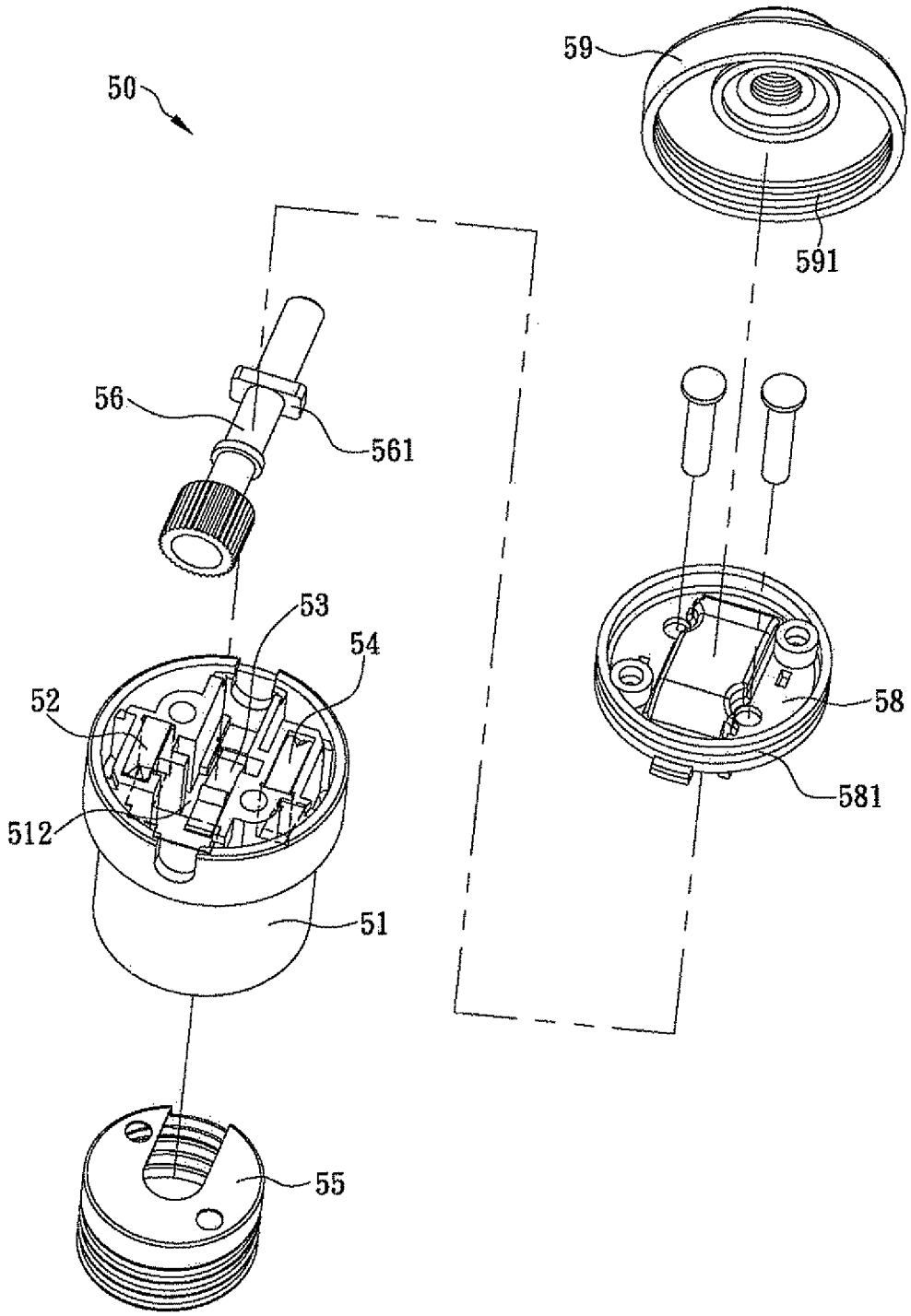
FIG. 6 is a schematic view of a second preferred embodiment of the invention.
Figure 7:
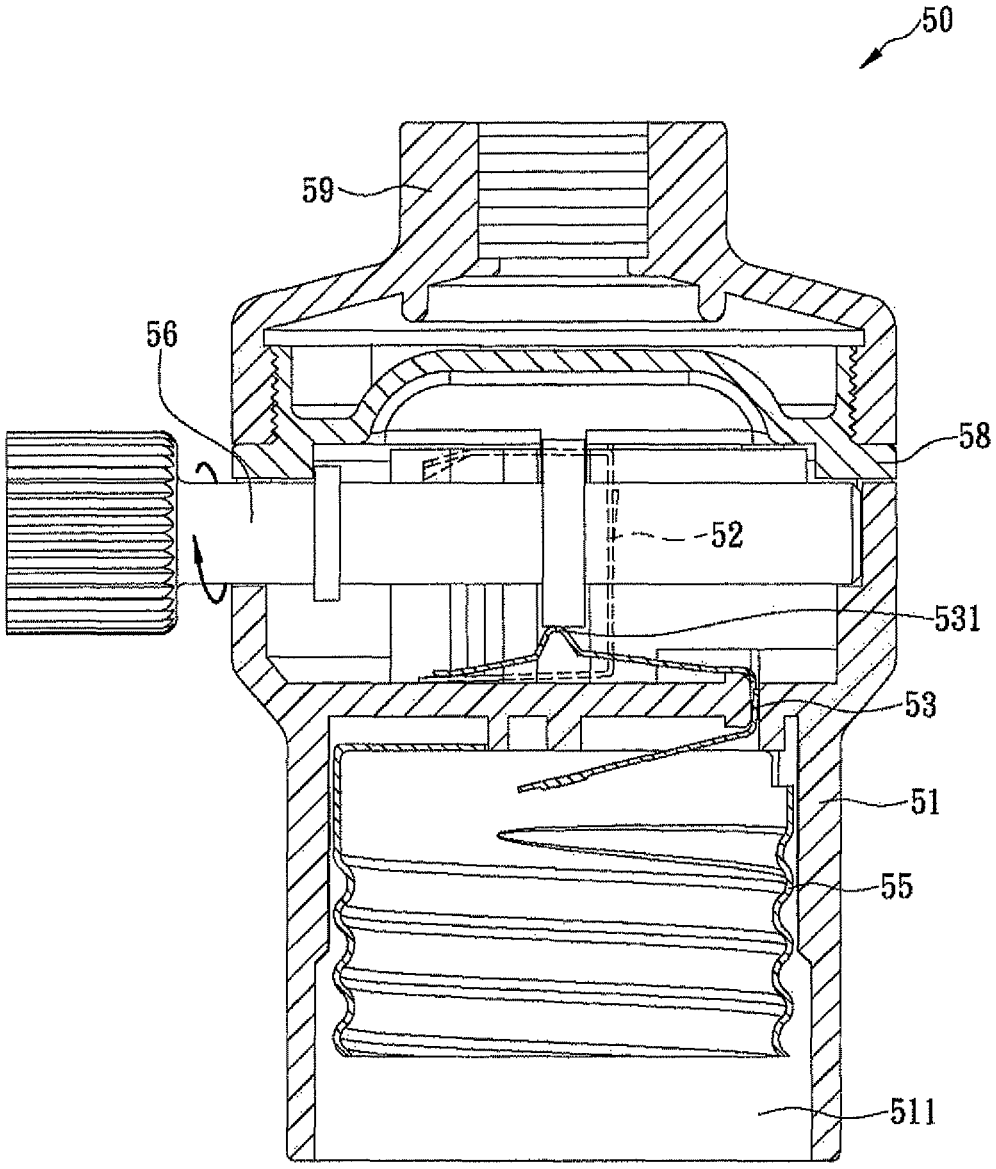
FIG. 7 is another schematic view of a second preferred embodiment of the invention.

With reference of FIGS. 6 and 7 for a second preferred embodiment of the present invention, the pressing element 56 of the lamp holder structure 50 is an axle rotatable in the universal accommodating slot 512. The pressing element 56 includes at least one pressing portion 561 that can be rotated with the pressing element 56 to press against a flange 531 of the metal spring plate 53, such that the metal spring plate 53 can be connected to the first electrically conductive plate 52 or detached from the flange 531 of the metal spring plate 53 to electrically disconnect the metal spring plate 53 from the first electrically conductive plate 52. In addition, the second electrically conductive plate 54 is installed at the top of the main body 51 and at a position proximate to the universal accommodating slot 512, and an end of the second electrically conductive plate 54 is extended into the accommodating space 511 at the bottom of the main body 51 and abutted against the top of the lamp holder base 55 in the accommodating space 511, so that the lamp holder base 55 and the second electrically conductive plate 54 can be electrically coupled, and the other end of the second electrically conductive plate 54 can be electrically coupled to a second electric wire (not shown in the figure, but it is similar to the second electric wire 414 in FIG. 4).

In this preferred embodiment, an internal thread 591 is formed at an internal periphery of the external cover 59, and an external thread 581 is formed at an external periphery of the internal cover 58, and the internal thread 591 of the external cover 59 is screwed and coupled to the external thread 581 of the internal cover 58 to integrally engage the external cover 59 and the internal cover 58.

Figure 8:
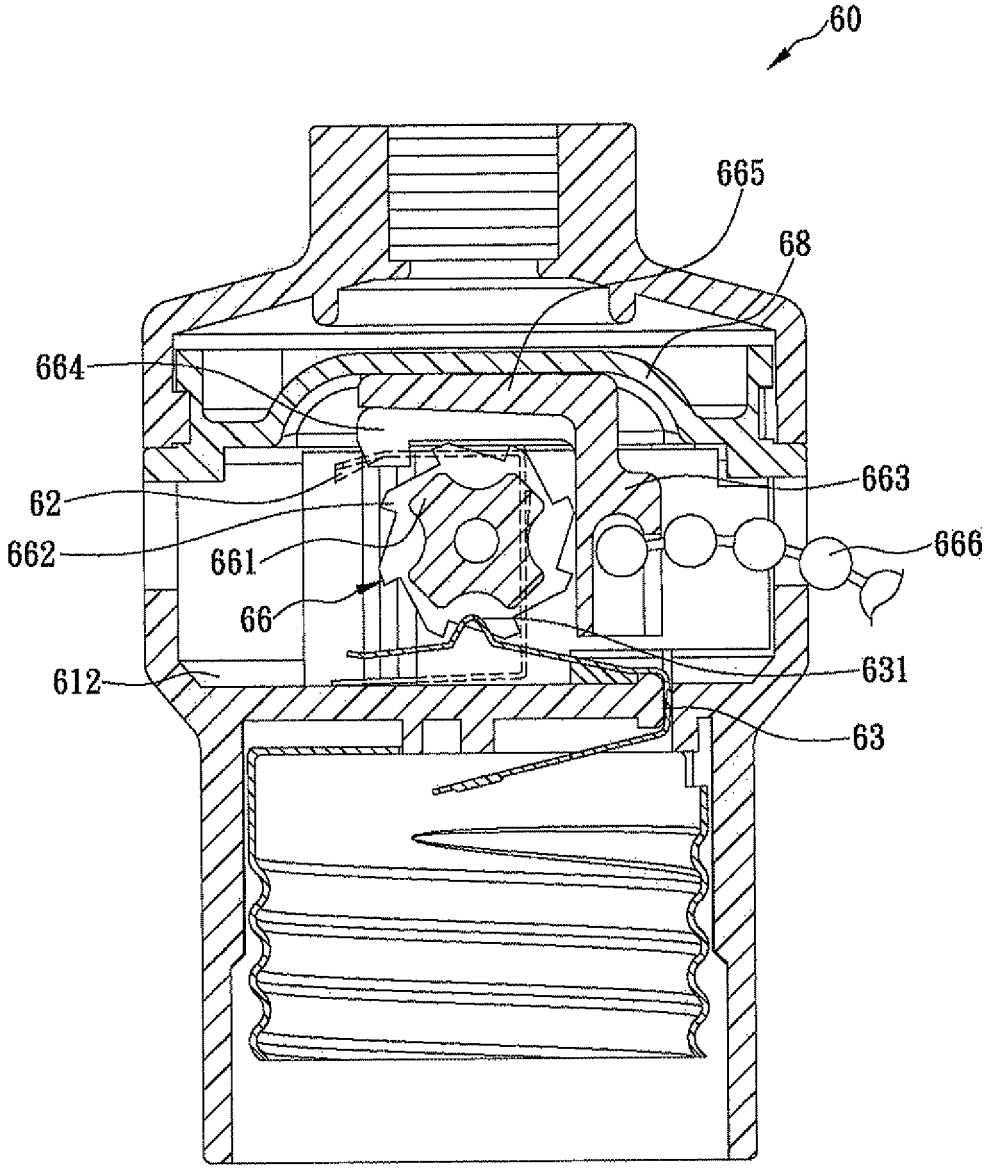
FIG. 8 is a schematic view of a third preferred embodiment of the present.

With reference to FIG. 8 for a third preferred embodiment of the present invention, a pressing element 66 of a lamp holder structure 60 is pivotally installed into the universal accommodating slot 612, and movable in the universal accommodating slot 612, wherein the pressing element 66 of this preferred embodiment is a roller having a plurality of gear portions 662 convexly protruded from two corresponding lateral edges. At least one pressing portion 661 is formed at the central position of the roller and can be rotated together with the pressing element 66 and pressed against a flange 631 of the metal spring plate 63, such that the metal spring plate 63 can be electrically coupled to the first electrically conductive plate 62 or detached from the flange 631 of the metal spring plate 63 to electrically disconnect the metal spring plate 63 from the first electrically conductive plate 62. A driving element 663 is installed in the universal accommodating slot 612 and at a position proximate to the pressing element 66, and at least one hook 664 and an elastic element 665 are installed at an end of the driving element 663, wherein the hook 664 is attached onto the corresponding gear portion 662 of the pressing element 66 by the gravitational force. The hook 664 can drive and move the gear portion 662 such that the pressing element 66 can be rotated together with the movement of the gear portion 662. The top of the elastic element 665 is attached and fixed to the bottom of the internal cover 68, and the other end of the driving element 663 is coupled to a stringer bead 666, such that if an external force is applied to the stringer bead 666 in a direction away from the pressing element 66, the stringer bead 666 will drive the driving element 663 to move in a direction away from the pressing element 66, and the hook 664 on the driving element 663 will drive the pressing element 66 to rotate. The pressing portion 661 is moved together with the rotation of the pressing element 66 and pressed against the flange 631 of the metal spring plate 63. When no external force is applied to the driving element 663, the driving element 663 will be affected by the stress of the elastic element 665 to resume its original position proximate to the pressing element 66.

Figure 9:
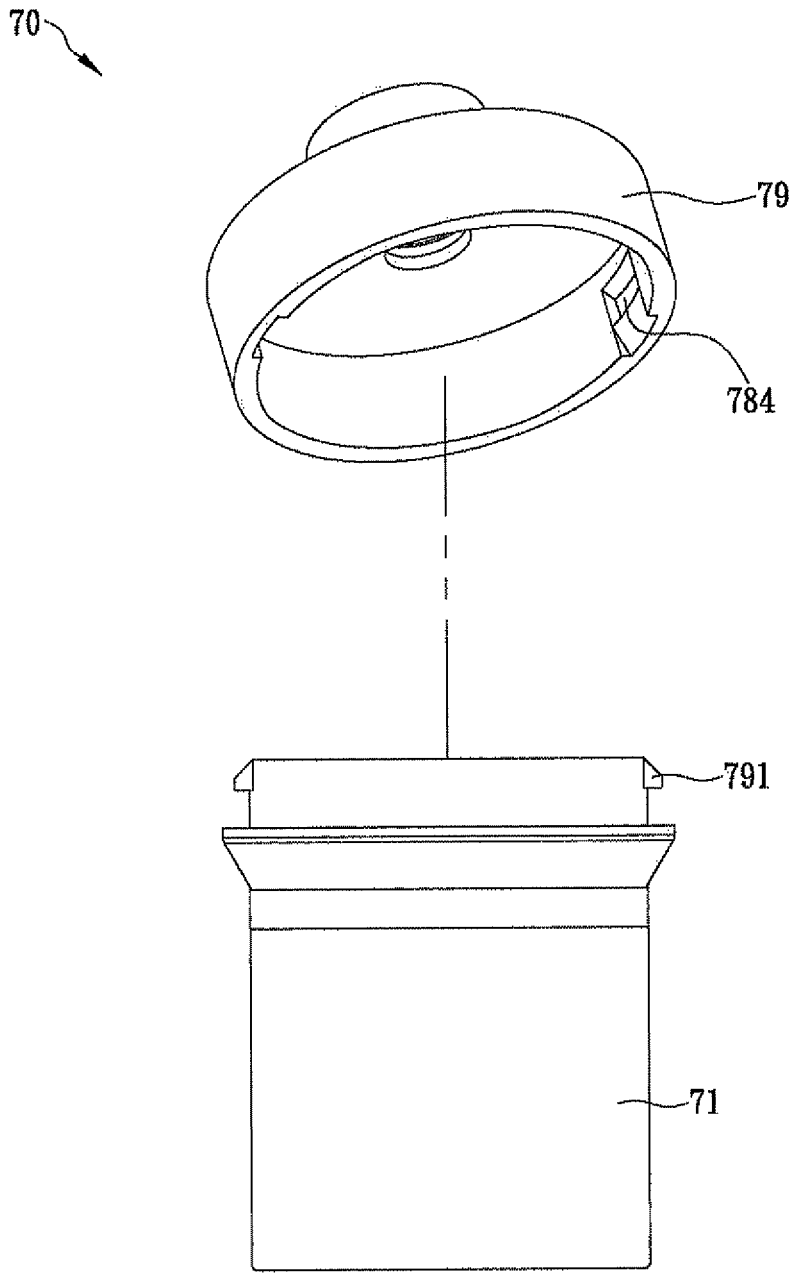
FIG. 9 is a schematic view of a fourth preferred embodiment of the invention.

With reference to FIG. 9 for a fourth preferred embodiment of the present invention, the lamp holder structure 70 further comprises an external cover 79, a plurality of embedding grooves 784 concavely formed at an internal periphery of the external cover 79, a plurality of bumps 791 convexly formed at an external periphery proximate to the top of the main body 71 and corresponding to the embedding grooves 784 respectively, such that each bump 791 can be embedded into the corresponding embedding groove 784, and the main body 71 can be integrally engaged with the external cover 79 through the bumps 791.

The components including the pressing element, the internal cover and the external cover as well as the assembling method of the main body, the internal cover and the external cover are described in the preferred embodiments for illustrating the present invention. While the invention has been described by means of specific embodiments, numerous modifications and variations could be made thereto by those skilled in the art without departing from the scope of the invention set forth in the claims.

What is claimed is:

1. A lamp holder structure with a universal accommodating slot, comprising:

a main body, including an accommodating space concavely formed at the bottom of the main body, and a universal accommodating slot concavely formed at the top of the main body;

a first electrically conductive plate, installed at the top of the main body and at a position proximate to the universal accommodating slot, and an end of the first electrically conductive plate being extended to the bottom of the universal accommodating slot, and the other end of the first electrically conductive plate being provided for electrically coupling a first electric wire;

a metal spring plate, embedded into the main body, and an end of the metal spring plate being extended into the accommodating space and the other end of the metal spring plate being extended into the universal accommodating slot, and maintaining a predetermined interval from an end of the first electrically conductive plate, and the other end of the metal spring plate being pressed by an external force to abut an end of the first electrically conductive plate or affected by a stress of the metal spring plate to detach from the first electrically conductive plate;

a second electrically conductive plate, installed at a position at the top of the main body and proximate to the universal accommodating slot, and an end of the second electrically conductive plate being extended into the accommodating space of the main body, and the other end of the second electrically conductive plate being provided for electrically coupling a second electric wire;

a lamp holder base, accommodated in the accommodating space, and the top of the lamp holder base being pressed against an end of the second electrically conductive plate and electrically coupled to the second electrically conductive plate, and an opening being formed on the lamp holder base for extending an end of the metal spring plate through the opening into the lamp holder base, and an assembling slot being concavely formed in the lamp holder base and provided for assembling a lamp cap of an illumination lamp; and a pressing element, accommodated in the universal accommodating slot, and rotatable or reciprocally movable in the universal accommodating slot, and having at least one pressing portion formed on the pressing element and rotatable or movable with the pressing element to press against a flange of the metal spring plate, such that the metal spring plate is electrically coupled to the first electrically conductive plate or detached from the flange of the metal spring plate to electrically disconnect the metal spring plate from the first electrically conductive plate.

2. The lamp holder structure with a universal accommodating slot as recited in claim 1, wherein the metal spring plate includes a flange formed at a position proximate to the other end of the metal spring plate, and if an external force is applied to press the flange, the other end of the metal spring plate is driven to press against an end of the first electrically conductive plate, and if no external force is applied to the flange, the other end of the metal spring plate is detached from the first electrically conductive plate by the stress of the metal spring plate.

3. The lamp holder structure with a universal accommodating slot as recited in claim 2, wherein the pressing element is pivotally installed in the universal accommodating slot, and a plurality of gear portions is protruded from both corresponding lateral edges, and the pressing portion is disposed at the central position.

4. The lamp holder structure with a universal accommodating slot as recited in claim 3, further comprising a driving element installed in the universal accommodating slot and at a position proximate to the pressing element, and at least one hook and an elastic element installed at an end of the driving element, and the hook being attached onto the corresponding gear portion on the pressing element and moved in a direction away from the pressing element to drive and rotate the gear portion and the pressing element, and the top of the elastic element being attached and positioned at the bottom of the internal cover, and the other end of the driving element being coupled to a stringer bead, such that an external force can be applied to the stringer bead to drive the driving element to move in a direction away from the pressing element, and if no external force is applied to the driving element, the driving element resumes its original position proximate to the pressing element by the stress of the elastic element.

5. The lamp holder structure with a universal accommodating slot as recited in claim 1, further comprising an external cover, a plurality of embedding grooves concavely formed at an internal periphery of the external cover, and a plurality of bumps formed at an external periphery proximate to the top of the main body, and the bumps being embedded into the corresponding embedding grooves respectively, such that the main body can be integrally engaged to the external cover by the bumps.

6. The lamp holder structure with a universal accommodating slot as recited in claim 2, further comprising an external cover, a plurality of embedding grooves concavely formed at an internal periphery of the external cover, and a plurality of bumps formed at an external periphery proximate to the top of the main body, and the bumps being embedded into the corresponding embedding grooves respectively, such that the main body can be integrally engaged to the external cover by the bumps.

7. The lamp holder structure with a universal accommodating slot as recited in claim 3, further comprising an external cover, a plurality of embedding grooves concavely formed at an internal periphery of the external cover, and a plurality of bumps formed at an external periphery proximate to the top of the main body, and the bumps being embedded into the corresponding embedding grooves respectively, such that the main body can be integrally engaged to the external cover by the bumps.

8. The lamp holder structure with a universal accommodating slot as recited in claim 4, further comprising an external cover, a plurality of embedding grooves concavely formed at an internal periphery of the external cover, and a plurality of bumps formed at an external periphery proximate to the top of the main body, and the bumps being embedded into the corresponding embedding grooves respectively, such that the main body can be integrally engaged to the external cover by the bumps.

9. The lamp holder structure with a universal accommodating slot as recited in claim 1, further comprising an internal cover, and two positioning holes formed on the internal cover, and each positioning hole being provided for passing a positioning element, such that the internal cover is secured or riveted to the top of the main body by the two positioning elements.

10. The lamp holder structure with a universal accommodating slot as recited in claim 2, further comprising an internal cover, and two positioning holes formed on the internal cover, and each positioning hole being provided for passing a positioning element, such that the internal cover is secured or riveted to the top of the main body by the two positioning elements.

11. The lamp holder structure with a universal accommodating slot as recited in claim 3, further comprising an internal cover, and two positioning holes formed on the internal cover, and each positioning hole being provided for passing a positioning element, such that the internal cover is secured or riveted to the top of the main body by the two positioning elements.

12. The lamp holder structure with a universal accommodating slot as recited in claim 4, further comprising an internal cover, and two positioning holes formed on the internal cover, and each positioning hole being provided for passing a positioning element, such that the internal cover is secured or riveted to the top of the main body by the two positioning elements.

13. The lamp holder structure with a universal accommodating slot as recited in claim 9, further comprising an external cover, a plurality of bumps formed at an internal periphery of the external cover, and a plurality of embedding grooves concavely formed at an external periphery of the internal cover, and the bumps being embedded into the corresponding embedding grooves respectively, such that the external cover is integrally embedded and coupled to the internal cover by the bumps.

14. The lamp holder structure with a universal accommodating slot as recited in claim 10, further comprising an external cover, a plurality of bumps formed at an internal periphery of the external cover, and a plurality of embedding grooves concavely formed at an external periphery of the internal cover, and the bumps being embedded into the corresponding embedding grooves respectively, such that the external cover is integrally embedded and coupled to the internal cover by the bumps.

15. The lamp holder structure with a universal accommodating slot as recited in claim 11, further comprising an external cover, a plurality of bumps formed at an internal periphery of the external cover, and a plurality of embedding grooves concavely formed at an external periphery of the internal cover, and the bumps being embedded into the corresponding embedding grooves respectively, such that the external cover is integrally embedded and coupled to the internal cover by the bumps.

16. The lamp holder structure with a universal accommodating slot as recited in claim 12, further comprising an external cover, a plurality of bumps formed at an internal periphery of the external cover, and a plurality of embedding grooves concavely formed at an external periphery of the internal cover, and the bumps being embedded into the corresponding embedding grooves respectively, such that the external cover is integrally embedded and coupled to the internal cover by the bumps.

17. The lamp holder structure with a universal accommodating slot as recited in claim 9, further comprising an external cover, an internal thread formed at an internal periphery of the external cover, an external thread formed at an external periphery of the internal cover, and the internal thread of the external cover being screwed and coupled to the external thread of the internal cover.

18. The lamp holder structure with a universal accommodating slot as recited in claim 10, further comprising an external cover, an internal thread formed at an internal periphery of the external cover, an external thread formed at an external periphery of the internal cover, and the internal thread of the external cover being screwed and coupled to the external thread of the internal cover.

19. The lamp holder structure with a universal accommodating slot as recited in claim 11, further comprising an external cover, an internal thread formed at an internal periphery of the external cover, an external thread formed at an external periphery of the internal cover, and the internal thread of the external cover being screwed and coupled to the external thread of the internal cover.

20. The lamp holder structure with a universal accommodating slot as recited in claim 12, further comprising an external cover, an internal thread formed at an internal periphery of the external cover, an external thread formed at an external periphery of the internal cover, and the internal thread of the external cover being screwed and coupled to the external thread of the internal cover.

* * * * *